US007885584B2

(12) United States Patent
Stern et al.

(10) Patent No.: US 7,885,584 B2
(45) Date of Patent: Feb. 8, 2011

(54) SELF-CLEANING ELECTROPHOTOGRAPHIC TONING ROLLER SYSTEM

(75) Inventors: Philip A. Stern, Rochester, NY (US); Edward M. Eck, Lima, NY (US); Paul E. Thompson, Webster, NY (US); Timothy Reynolds, Rochester, NY (US); Gerard M. Darby, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 738 days.

(21) Appl. No.: 11/770,870

(22) Filed: Jun. 29, 2007

(65) Prior Publication Data

US 2009/0003887 A1 Jan. 1, 2009

(51) Int. Cl.
*G03G 15/09* (2006.01)

(52) U.S. Cl. ..... 399/273; 399/35; 399/99; 399/264; 399/283; 399/360

(58) Field of Classification Search ..... 399/35, 399/99, 264, 273, 283, 360
See application file for complete search history.

(56) References Cited

U.S. PATENT DOCUMENTS 4,473,029 A 9/1984 Fritz et al.
4,546,060 A 10/1985 Miskinis et al.
4,557,584 A 12/1985 Donnelly
4,602,863 A 7/1986 Fritz et al.
4,947,211 A * 8/1990 Ono et al. ..... 399/283
5,001,028 A 3/1991 Mosehauer et al.
5,084,735 A 1/1992 Rimai et al.
5,307,124 A 4/1994 Stelter
5,339,146 A 8/1994 Aslam et al.
5,370,961 A 12/1994 Zaretsky et al.
5,376,492 A 12/1994 Stelter et al.
5,394,230 A 2/1995 Kaukeinen et al.
5,400,124 A 3/1995 Kass et al.
5,409,791 A 4/1995 Kaukeinen et al.
5,464,698 A 11/1995 Chen et al.
5,489,975 A 2/1996 Kaukeinen et al.
5,506,372 A * 4/1996 Guth et al. ..... 399/254
5,506,671 A 4/1996 Buts et al.
5,728,496 A 3/1998 Rimai et al.
5,751,432 A 5/1998 Gwaltney
5,807,651 A 9/1998 Rimai et al.
5,821,972 A 10/1998 Mey et al.

(Continued)

FOREIGN PATENT DOCUMENTS

JP 59170868 9/1984

(Continued)

OTHER PUBLICATIONS

English abstract of JP 05061384 A to Osaki et al.*

(Continued)

*Primary Examiner*—Ryan D Walsh
(74) *Attorney, Agent, or Firm*—Donna P. Suchy

(57) ABSTRACT

An apparatus and related method for a self-cleaning toner roller device adjacent a toner roller. The cleaning device having one or more shields to capture the toner debris from the toner roller, a toner debris receptacle to collect the toner debris, and a controller to move the applicator from an operational mode to a self-cleaning mode.

20 Claims, 4 Drawing Sheets

U.S. PATENT DOCUMENTS

| | | | | |
|---|---|---|---|---|
| 5,948,585 | A | 9/1999 | Gady et al. | |
| 5,966,576 | A | 10/1999 | Tyagi et al. | |
| 5,968,656 | A | 10/1999 | Ezenyilimba et al. | |
| 5,985,499 | A | 11/1999 | Guth et al. | |
| 6,074,756 | A | 6/2000 | Vreeland et al. | |
| 6,184,911 | B1 | 2/2001 | Tombs | |
| 6,224,978 | B1 | 5/2001 | Chen et al. | |
| 6,352,806 | B1 | 3/2002 | Dalal | |
| 6,377,772 | B1 | 4/2002 | Chowdry et al. | |
| 6,393,226 | B1 | 5/2002 | Charlebois et al. | |
| 6,526,247 | B2 | 2/2003 | Stelter et al. | |
| 6,589,703 | B2 | 7/2003 | Stelter et al. | |
| 6,608,641 | B1 | 8/2003 | Alexandrovich et al. | |
| 2002/0168200 | A1 | 11/2002 | Stelter et al. | |
| 2003/0091921 | A1 | 5/2003 | Stelter et al. | |
| 2003/0175053 | A1 | 9/2003 | Stelter et al. | |
| 2004/0234309 | A1 * | 11/2004 | Nagata et al. | 399/348 |
| 2008/0080913 | A1 * | 4/2008 | Van Bortel et al. | 399/341 |

FOREIGN PATENT DOCUMENTS

| | | | |
|---|---|---|---|
| JP | 60196784 | | 10/1985 |
| JP | 61067067 | | 4/1986 |
| JP | 01059269 | | 3/1989 |
| JP | 05061384 | A * | 3/1993 |

OTHER PUBLICATIONS

Y. S. Ng, et al., Imaging Science and Technology, 47th Annual Conference Proceedings (1994) pp. 622-625.

* cited by examiner

SELF-CLEANING ELECTROPHOTOGRAPHIC TONING ROLLER SYSTEM

FIELD OF THE INVENTION

The invention relates to cleaning deposits from toning rollers in a toning apparatus for a printer and more specifically to a electrophotographic printer using a two-component developer material including a powder toner and a charge carrier material.

BACKGROUND OF THE INVENTION

Electrographic printers use a toner station and related processes for mixing and delivering the developer or toner used during the printing process. The term "electrographic printer," is intended to encompass electrophotographic printers and copiers that employ dry toner developed on an electrophotographic receiver element. The electrographic apparatus often incorporates an electromagnetic brush station, to develop the toner to a substrate (an imaging/photoconductive member bearing a latent image), after which the applied toner is transferred onto a sheet and fused thereon. Related prior art can be found in U.S. Pat. Nos. 4,473,029 and 4,546,060, and U.S. Patent Application Nos. 2002/0168200 and 2003/0091921.

U.S. Pat. Nos. 6,526,247 and 6,589,703 and U.S. Patent Application Publication Nos. 2002/0168200; 2003/0091921; and 2003/0175053 provide additional description of magnetic brush technology using a rotating magnetic core for use in electrographic development apparatus. An essential feature of magnetic brush technology using a rotating magnetic core is that the magnetic field in the development zone has a rotating magnetic field vector. U.S. Pat. Nos. 6,526,247 and 6,589,703 and United States Patent Application Publication Nos. 2002/0168200; 2003/0091921; and 2003/0175053 are hereby incorporated by reference as if fully set forth herein.

U.S. Pat. Nos. 4,473,029; 4,546,060; and 4,602,863 provide a description of magnetic brush technology using a rotating magnetic core for use in electrographic development apparatus. U.S. Pat. Nos. 4,473,029; 4,546,060, and 4,602,863, and U.S. Patent Application Publication Numbers 2002/0168200 and 2003/0091921 are hereby incorporated by reference as if fully set forth herein.

U.S. Pat. No. 5,400,124 provides a description of magnetic brush technology using a rotating magnetic core and a stationary toning shell for applying toner to an electrostatic image. U.S. Pat. No. 5,966,576 provides a description of an alternate configuration of toning station also having rotating magnetic field vectors, in which a plurality of rotatable magnets are located adjacent to the underside of the development surface of the applicator sleeve to move developer material through the development zone. U.S. Pat. No. 5,376,492 discusses development using a rotating magnetic core and an AC developer bias. U.S. Pat. Nos. 5,400,124; 5,966,576; and 5,376,492 are hereby full incorporated by reference as if fully set forth herein.

U.S. Pat. No. 5,307,124 discusses pre-charging toner before feeding into the developer sump containing partially depleted two-component developer material. U.S. Pat. No. 5,506,372 discusses a development station having a particle removal device for removing aged magnetic carrier to compensate for the addition of fresh carrier.

Depositing multiple layers of toner on a substrate by direct deposition from a magnetic brush includes U.S. Pat. Nos. 5,001,028 and 5,394,230, which discuss a process for producing two or more toner images in a single frame or area of an image member using two or more magnetic brush development stations with rotating magnetic cores. In this process, a region of an electrostatic receiver is developed with a first toner of a first polarity and then the receiver with a deposit of charged toner particles is passed through a second magnetic brush using a second toner of the first polarity, which deposits the second toner on the receiver. U.S. Pat. Nos. 5,409,791; 5,489,975; and 5,985,499 discuss a process for developing an electrostatic image on an image member already containing a loose dry first toner image with a second toner having the same electrical polarity as the first toner, using rotating magnetic core technology and AC projection toning, where the developer nap is not in contact with the receiver. U.S. Pat. Nos. 5,307,124; 5,506,372; 5,001,028; 5,394,230; 5,409,791; 5,489,975; and 5,985,499 are hereby incorporated by reference as if fully set forth herein.

For depositing multiple layers of toner on a substrate by transfer of the toner from an intermediate transfer member, intermediate transfer medium, or ITM, U.S. Pat. No. 5,084,735 and U.S. Pat. No. 5,370,961 disclose use of a compliant ITM roller coated by a thick compliant layer and a relatively thin hard overcoat to improve the quality of electrostatic toner transfer from an imaging member to a receiver, as compared to a non-compliant intermediate roller. Additional applications of hard overcoats on intermediate transfer members are disclosed in U.S. Pat. No. 5,728,496 and U.S. Pat. No. 5,807,651, which describe an overcoated photoconductor and overcoated transfer member, U.S. Pat. No. 6,377,772, which describes composite intermediate transfer members, and U.S. Pat. No. 6,393,226, which describes an intermediate transfer member having a stiffening layer. U.S. Pat. Nos. 5,084,735; 5,370,961; 5,728,496: 5,807,651; 6,377,772; and 6,393,226 are hereby incorporated by reference as if fully set forth herein.

U.S. Pat. No. 6,608,641 describes a printer for printing color toner images on a receiver member of any of a variety of textures. The printer has a number of electrophotographic image-forming modules arranged in tandem (see for example, Tombs, U.S. Pat. No. 6,184,911). These include a plurality of imaging subsystems to form a colored toner image that is transferred to a receiver member, the transfer of toner images from each of the modules forming a color print on the receiver member which is fused to form a desired color print. U.S. Pat. Nos. 6,608,641 and 6,184,911 are hereby incorporated by reference as if fully set forth herein. Such a printer includes two or more single-color image forming stations or modules arranged in tandem and an insulating transport web for moving receiver members such as paper sheets through the image forming stations, wherein a single-color toner image is transferred from an image carrier, i.e., a photoconductor (PC) or an intermediate transfer member (ITM), to a receiver held electrostatically or mechanically to the transport web, and the single-color toner images from each of the two or more single-color image forming stations are successively laid down one upon the other to produce a plural or multicolor toner image on the receiver.

As is well known, a toner image may be formed on a photoconductor by the sequential steps of uniformly charging the photoconductor surface in a charging station using a corona charger, exposing the charged photoconductor to a pattern of light in an exposure station to form a latent electrostatic image, and toning the latent electrostatic image in a development station to form a toner image on the photoconductor surface. The toner image may then be transferred in a transfer station directly to a receiver, e.g., a paper sheet, or it may first be transferred to an ITM and subsequently transferred to the receiver. The toned receiver is then moved to a fusing station where the toner image is fused to the receiver by heat and/or pressure.

In a digital electrophotographic copier or printer, a uniformly charged photoconductor surface may be exposed pixel by pixel using an electro-optical exposure device comprising light emitting diodes, such as for example described by Y. S. Ng et al., Imaging Science and Technology, 47th Annual Conference Proceedings (1994), pp. 622-625.

A widely practiced method of improving toner transfer is by use of so-called surface treated toners. As is well known, surface treated toner particles have adhered to their surfaces sub-micron particles, e.g., of silica, alumina, titania, and the like (so-called surface additives or surface additive particles). Surface treated toners generally have weaker adhesion to a smooth surface than untreated toners, and therefore surface treated toners can be electrostatically transferred more efficiently from a PC or an ITM to another member.

As disclosed in the Rimai et al. patent (U.S. Pat. No. 5,084,735), in the Zaretsky and Gomes patent (U.S. Pat. No. 5,370,961) and in subsequent U.S. Pat. Nos. 5,821,972; 5,948,585; 5,968,656; 6,074,756; 6,377,772; 6,393,226; and 6,608,641, use of a compliant ITM roller coated by a thick compliant layer and a relatively thin hard overcoat improves the quality of electrostatic toner transfer from an imaging member to a receiver, as compared to a non-compliant intermediate roller. U.S. Pat. Nos. 5,084,735; 5,370,961; 5,728,496; 5,807,651; 5,821,972; 5,948,585; 5,968,656; 6,074,756; 6,377,772; 6,393,226; and 6,608,641 are hereby incorporated by reference as if fully set forth herein.

A receiver carrying an unfused toner image may be fused in a fusing station in which a receiver carrying a toner image is passed through a nip formed by a heated compliant fuser roller in pressure contact with a hard pressure roller. Compliant fuser rollers are well known in the art. For example, the Chen et al. patent (U.S. Pat. No. 5,464,698) discloses a toner fuser member having a silicone rubber cushion layer disposed on a metallic core member, and overlying the cushion layer, a layer of a cured fluorocarbon polymer in which is dispersed a particulate filler. Also, in the Chen et al. U.S. Pat. No. 6,224,978 is disclosed an improved compliant fuser roller including three concentric layers, each of which layers includes a particulate filler. Additional fusing means known in the art, such as non-contact fusing using IR radiation, oven fusing, or fusing by vapors may also be used. U.S. Pat. Nos. 5,464,698 and 6,224,978 are hereby incorporated by reference as if fully set forth herein.

U.S. Pat. Nos. 5,339,146; 5,506,671; 5,751,432; and 6,352,806 discuss means of forming overcoats on receivers with charged particles in the context of electrographic imaging. U.S. Pat. No. 5,339,146 uses a fusing surface or belt as an intermediate transfer member. This patent discloses mixing a clear particulate material with a magnetic carrier. The clear particulate material is applied using an applicator consisting of a conventional magnetic brush development device. The applicator, using a rotating magnetic core and/or a rotatable shell, moves the developer mixture through contact with the fusing surface to deposit the particulate material on it. An electrical field is applied between the applicator and belt to assist this application. The fusing belt is preferably a metal belt with a smooth hard surface. U.S. Pat. No. 5,506,671 discloses an electrostatographic printing process for forming one or more colorless toner images in combination with at least one color toner image. At each image-producing station an electrostatic latent image is formed on a rotatable endless surface; toner is deposited on the electrostatic latent image to form a toner image on the rotatable surface, and the toner image is transferred from its corresponding rotatable surface onto the receptor element. U.S. Pat. No. 5,751,432 is directed to glossing selected areas of an imaged substrate and, in particular, to creating xerographic images, portions of which include clear polymer for causing them to exhibit high gloss thereby causing them to be highlighted. The clear toner may be applied to color toner image areas as well as black image areas. Additionally, the clear toner may be applied to non-imaged areas of the substrate. In carrying out the invention, a fifth developer housing is provided in a color image creation apparatus normally including only four developer housings. U.S. Pat. No. 6,352,806 concerns a color image reproduction machine that includes means for forming an additional toner image using clear colorless toner particles, thereby resulting in a uniform gloss of the full-gamut color toner image.

In typical commercial electrostatographic reproduction apparatus (copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern at a developing station to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

The process of application of the toner to the photoconductive member is optimized to develop the latent image, and at the same time, minimize the transfer of material to the background or non-image areas. The charge of the image and non-image areas are such that correctly charged toner will be attracted to the image area and repelled from the non-image area. Sometimes, toner particles can become reversed-charged from their normal state, due to incorrect or insufficient dispersion of charging agent, or for other reasons. These reversed charged particles can become imaged to the background area, causing image defects.

In the development process, toning materials are often violently engaged with the photoconductive element in order to develop the latent image. This process can provide a source for airborne toner. This airborne toner can easily collect on surfaces near the development zone. As these deposits collect, they can build up and drop off the neighboring surfaces and be developed onto the photoconductive element.

Sometimes the two-component developer material, including a powder toner and a charge carrier material, can build up on the toner roller and when even small amount of toner build up, the subsequent intermittent release of this debris creates unacceptable printing artifacts. One reason this occurs is because the toner is either the wrong sign or 0 sign (neutral) and this material will show up in none image areas of the print as an artifact. This generates an unacceptable toner artifacts on prints from machines running, for instance, at faster rates or that required a high image quality. This debris release typically causes image defects and can accumulate to an extent that the machine must be shut down to be cleaned. It is therefore an object of the present invention to provide a self-cleaning toning roller device.

SUMMARY OF THE INVENTION

An apparatus and related method for preparing an artifact free eletrophotographic print by incorporating a toner roller self-cleaning device proximate one or more toner rollers. The cleaning device includes a cleaning shield to collect the toner debris from near the toner roller and a toner debris receptacle to collect the toner debris.

DETAILED DESCRIPTION OF THE INVENTION

Figure 1:
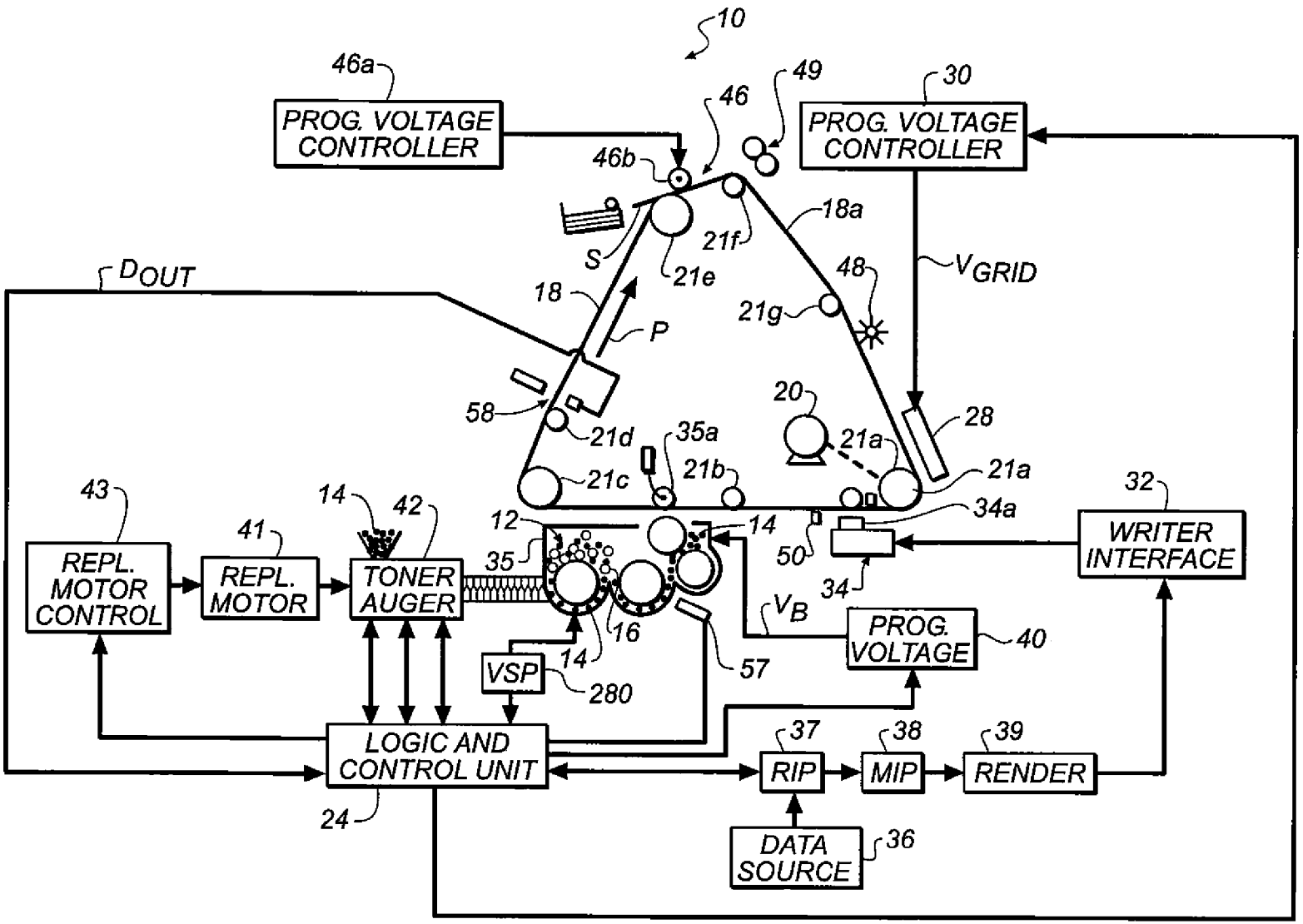
FIG. 1 presents a schematic view of a printer machine according to various aspects of the invention.

Referring now specifically to FIG. 1, a printer machine 10, such as an electrophotographic printer, that implements the electrographic developer mixing apparatus and processes of the invention is presented. The printer machine 10 in a preferred embodiment uses a two-component developer material 12 including a toner 14 and a charge carrier material 16. The printer machine 10 includes a moving electrographic imaging or receiver member 18 such as a photoconductive belt which is entrained about a plurality of rollers or other supports 21*a* through 21*g*, one or more of which is driven by a motor to advance the bell. By way of example, roller 21*a* is illustrated as being driven by motor 20. Motor 20 preferably advances the belt at a high speed, such as 20 inches per second or higher, in the direction indicated by arrow P, past a series of workstations of the printer machine 10. Alternatively, belt 18 may be wrapped and secured about only a single drum, or may be a drum.

Printer machine 10 includes a controller or logic and control unit (LCU) 24, preferably a digital computer or microprocessor operating according to a stored program for sequentially actuating the workstations within printer machine 10, effecting overall control of printer machine 10 and its various subsystems. LCU 24 also is programmed to provide closed-loop control of printer machine 10 in response to signals from various sensors and encoders. Aspects of process control are described in U.S. Pat. No. 6,121,986 incorporated herein by this reference.

A primary charging station 28 in printer machine 10 sensitizes belt 18 by applying a uniform electrostatic corona charge, from high-voltage charging wires at a predetermined primary voltage, to a surface 18*a* of belt 18. The output of charging station 28 is regulated by programmable voltage controller 30, which is in turn controlled by LCU 24 to adjust this primary voltage, for example by controlling the electrical potential of a grid and thus controlling movement of the corona charge. Other forms of chargers, including brush or roller chargers, may also be used.

An exposure station 34 in printer machine 10 projects light from a writer 34*a* to belt 18 in accordance with parameters supplied from a writer interface 32. This light selectively dissipates the electrostatic charge on photoconductive belt 18 to form a latent electrostatic image of the document to be copied or printed. Writer 34*a* is preferably constructed as an array of light emitting diodes (LEDs), or alternatively as another light source such as a laser or spatial light modulator. Writer 34*a* exposes individual picture elements (pixels) of belt 18 with light at a regulated intensity and exposure, in the manner described below.

After exposure, the portion of the belt bearing the lateral charge image travels to a development station 35, which can apply toner to the belt 18 by moving a backup roller or bar 35*a*, which will be discussed in more detail below. The exposing light discharges selected pixel locations of the photoconductor, so that the pattern of localized voltages across the photoconductor corresponds to the image to be printed. An image is a pattern of physical light, which may include characters., words, text, and other features such as graphics, photos, etc. An image may be included in a set of one or more images, such as in images of the pages of a document. An image may be divided into segments, objects, or structures each of which is itself an image. A segment, object or structure of an image may be of any size up to and including the whole image.

Image data to be printed is provided by an image data source 36, which is a device that can provide digital data defining a version of the image. Such types of devices are numerous and include computer or microcontroller, computer workstation, scanner, digital camera, etc. These data represent the location and intensity of each pixel that is exposed by the printer. Signals from image data source 36, in combination with control signals from LCU 24 are provided to a raster image processor (RIP) 37. The digital images (including styled text) are converted by the RIP 37 from their form in a page description language (PDL) to a sequence of serial instructions for the electrographic printer in a process commonly known as "ripping" and which provides a ripped image to an image storage and retrieval system known as a Marking Image Processor (MIP) 38.

In general, the major roles of the RIP 37 are to: receive job information from the server; parse the header from the print job and determine the printing and finishing requirements of the job; analyze the PDL (Page Description Language) to reflect any job or page requirements that were not stated in the header; resolve any conflicts between the requirements of the job and the Marking Engine configuration (i.e., RIP time mismatch resolution); keep accounting record and error logs and provide this information to any subsystem, upon request; communicate image transfer requirements to the Marking Engine; translate the data from PDL (Page Description Language) to Raster for printing; and support diagnostics communication between User Applications. The RIP accepts a print job in the form of a Page Description Language (PDL) such as PostScript, PDF or PCL and converts it into Raster, a form that the marking engine can accept. The PDL file received at the RIP describes the layout of the document as it was created on the host computer used by the customer. This conversion process is called rasterization. The RIP makes the decision on how to process the document based on what PDL the document is described in. It reaches this decision by looking at the first 2K of the document. A job manager sends the job information to a MSS (Marking Subsystem Services) via Ethernet and the rest of the document further into the RIP to get rasterized. For clarification, the document header contains printer-specific information such as whether to staple or duplex the job. Once the document has been converted to raster by one of the interpreters, the Raster data goes to the MIP 38 via RTS (Raster Transfer Services); this transfers the data over an IDB (Image Data Bus).

The MIP functionally replaces recirculation feeders on optical copiers. This means that images are not mechanically rescanned within jobs that require rescanning, but rather, images are electronically retrieved from the MIP to replace the rescan process. The MIP accepts digital image input and stores it for a limited time so it can be retrieved and printed to complete the job as needed. The MIP consists of memory for storing digital image input received from the RIP. Once the images are in MIP memory, they can be repeatedly read from memory and output to an image render circuit 39. Compressing the images can reduce the amount of memory required to store a given number of images; therefore, the images are compressed prior to MIP memory storage, and then decompressed while being read from MIP memory.

The output of the MIP is provided to the image render circuit 39, which alters the image and provides the altered image to the writer interface 32 (otherwise known as a write head, print head, etc.) which applies exposure parameters to the exposure medium, such as a photoconductor 18.

After exposure, the portion of exposure medium belt 18 bearing the latent charge images travels to a development station 35, including a toning station and toning roller. Development station 35 includes a magnetic brush in juxtaposition to the belt 18. Magnetic brush development stations are well known in the art, and are preferred in many applications. Alternatively, other known types of development stations or devices may be used. Development stations apply marking material onto the electrographic receiver or belt 18. The marking material may be comprised of a number of materials, such as toner, powder, etc. For exemplary purposes, the term toner will be used henceforth to describe the marking material, which is black and white. Plural development stations 35 may h be provided for developing images in plural colors, or from toners of different physical characteristics. Full process color electrographic printing is accomplished by utilizing this process for each of four toner colors (e.g., black, cyan, magenta, yellow).

When the imaged portion of the electrographic receiver, or belt 18, reaches the development station 35, the LCU 24 selectively activates the development station 35 to apply toner to belt 18 by moving the backup roller or bar 35*a* against the belt 18, into engagement with or close proximity to the magnetic brush. Alternatively, the magnetic brush may be moved toward belt 18 to selectively engage belt 18. In either case, charged toner particles on the magnetic brush are selectively attracted to the latent image patterns present on belt 18, developing those image patterns. As the exposed photoconductor passes the developing station, toner is attracted to pixel locations of the photoconductor and as a result, a pattern of toner corresponding to the image to be printed appears on the photoconductive belt 18, thereby forming a developed image on the electrostatic image. As known in the art, conductor portions of development station 35, such as conductive applicator cylinders, are biased to act as electrodes. The electrodes are connected to a variable supply voltage, which is regulated a by programmable controller 40 in response to the LCU 24, there by controlling the development process.

Development station 35 may contain a two-component developer mix including a dry mixture of toner or powder and carrier particles. Typically the carrier preferably has high coercivity (hard magnetic) ferrite particles. As an example, the carrier particles have a volume-weighted diameter of approximately 26μ. The dry toner particles are substantially smaller, on the order of 6μ to 15μ in volume-weighted diameter. Development station 35 may include an applicator having a magnetic core within a shell, either of which may be rotatably driven by a motor or other suitable driving means. Relative rotation of the core and shell moves the developer through a development zone in the presence of an electrical field. In the course of development, the toner selectively electrostatically adheres to photoconductive belt 18 to develop the electrostatic images thereon and the carrier material remains at development station 35. As toner is depleted from the development station due to the development of the electrostatic image. Additional toner is periodically introduced by a toner replenisher 42 driven by a replenisher motor 41 into development station 35 in response to a replenisher motor control 43. The toner is mixed with the carrier particles to maintain a uniform amount of development mixture. This development mixture is controlled in accordance with various development control processes that use information gathered from various devices, such as one or more toner concentration monitors 57. Single component developer stations, as well as conventional liquid toner development stations, may also be used.

A transfer station 46 in printing machine 10, including a programmable voltage controller 46*a* and roller 46*b*, moves a receiver (such as a sheet S) into engagement with photoconductive belt 18, in registration with a developed image to transfer the developed image to receive S. Receiver S may be plain or coated paper, plastic, or another medium capable of being handled by printer machine 10, such as a sheet, web, roll, or intermediate for intermediate transfer. Typically, transfer station 46 includes a charging device for electrostatically biasing movement of the toner particles from belt 18 to receiver sheet S. In this example, the biasing device is roller 46*b*, which engages the back of the receiver S and which is connected to programmable voltage controller 46*a* that operates in a constant current mode during transfer. Alternatively, an intermediate member may have the image transferred to it and the image may then be transferred to a receiver. After transfer of the toner image to a receiver, it is detacked from belt 18 and transported to fuser station 49 where the image is fixed onto the receiver, typically by the application of heat. Alternatively, the image may be fixed to the receiver at the time of transfer. A fuser entry guide may be implemented between the transfer station 46 and the fuser station, for example, as described in U.S. patent application Ser. No. 10/668,416 filed Sep. 23, 2003, in the names of John Giannetti, Giovanni B. Caiazza, and Jerome F. Sleve, the contents of which are incorporated by reference as if fully set forth herein.

A cleaning station 48, such as a brush, blade, or web is also located adjacent belt 18 behind transfer station 46, and removes residual toner from belt 18. A pre-clean charger (not shown) may be located before or at cleaning station 48 to assist in this cleaning. After cleaning, this portion of belt 18 is then ready for recharging and re-exposure. Of course, other portions of belt 18 are simultaneously located at the various workstations of printing machine 10, so that the printing process is carried out in a substantially continuous manner. In addition to a belt cleaning station this invention adds a self-cleaning toner roller device that can act in conjunction to the belt cleaner and printer, using the same controls as will be discussed below.

LCU 24 provides overall control of the apparatus and its various subsystems as is well known. LCU 24 will typically include temporary data storage memory, a central processing unit, timing and cycle control unit, and stored program control. Data input and output is performed sequentially through or under program control. Input data can be applied through input signal buffers to an input data processor, or through an interrupt signal processor, and include input signals from various switches, sensors, and analog-to-digital converters internal to printing machine 10, or received from sources external to printing machine 10, such from as a human user or a network control. The output data and control signals from LCU 24 are applied directly or through storage latches to suitable output drivers and in turn to the appropriate subsystems within printing machine 10.

Process control strategies generally utilize various sensors to provide real-time closed-loop control of the electrostatographic process so that printing machine 10 generates "constant" image quality output, from the user's perspective. Real-time process control is necessary in electrographic printing, to account for changes in the environmental ambient of the electrographic printer, and for changes in the operating conditions of the printer that occur over time during operation (rest/run effects). An important environmental condition parameter requiring process control is relative humidity, because changes in relative humidity affect the charge-to-mass ratio Q/m of toner particles. The ratio Q/m directly determines the density of toner that adheres to the photoconductor during development, and thus directly affects the density of the resulting image. An example of charges in operating conditions include system changes that can occur over time include changes due to aging of the printhead (exposure station), changes in the concentration of magnetic carrier particles to the toner as the toner is depleted through use, changes in the mechanical position of primary charger elements, aging of the electrographic receiver, variability in the manufacture of electrical components and of the electrographic receiver, change in conditions as the printer warms up after power-on, triboelectric charging of the toner, and other changes in electrographic process conditions. Because of these effects and the high resolution of modern electrographic printing, the process control techniques have become quite complex.

One process control sensor used is a densitometer 58, which monitors test patches that are exposed and developed in non-image areas of the photoconductive belt 18 under the control of LCU 24. Densitometer 58 may include an infrared or visible light LED, which either shines through the belt or is reflected by the belt onto a photodiode in densitometer. These developed test pitches are exposed to varying toner density levels, including full density and various intermediate densities, so that the actual density of toner in the patch can be compared with the desired density of toner as indicated by the various control voltages and signals. These densitometer measurements are used to control primary charging voltage $V_O$, maximum exposure light intensity $E_O$, and development station electrode bias $V_B$. In addition, the process control utilizes a toner replenishment control signal value or a toner concentration set point value to maintain the charge-to-mass ratio Q/m at a level that avoids dusting or hollow character formation due to low toner charge, and also avoids breakdown and transfer mottle due to high toner charge for improved accuracy in the process control of printing machine 10. The developed test patches are formed in the interframe area of belt 18 so that the process control can be carried out in real time without reducing the printed output throughput. Another sensor useful for monitoring process parameters in printer machine 10 is electrometer probe 50, mounted downstream of the charging station 28 relative to direction P of the movement of belt 18. An example of an electrometer is described in U.S. Pat. No. 5,956,544 incorporated herein by this reference.

Toner for use in the invention is, broadly, electrostatically chargeable powder for electrostatic coating systems, monocomponent development systems, or two-component development systems. Toner or powder particles are polymeric or resin-based. Although thermoplastic resins are useable, thermosetting powders are more preferred. In two-component development, the toner is mixed with magnetic carrier particles to form the developer, as explained above. The toner particles are created, in one embodiment, by blending various components, which can include binders, resins, pigments, fillers, and additives, for example, and processing the components by heating and milling, for example, whereupon a homogeneous mass is dispensed by an extruder. The mass is then cooled, crushed into small chips or lumps, and then ground into a powder.

The aforementioned additives incorporated within the particles can includes one or more of charge agents for tribocharging, flow aids for curing/fixing, cross-linkers to build up multiple chains, and catalysts to change the degree of cross-linking by initiating polymerization. Pigments can also be added to create a desired decorative effect. It is also contemplated to provide a powder in the form of a clear coat.

The performance of the developers is determined using an electrographic breadboard device as described in U.S. Pat. No. 4,473,029, the teaching of which have been previously incorporated herein in their entirety. The device has two electrostatic probes, one before a magnetic brush development station and one after the station to measure the voltage on the substrate before and after coating. The substrate (e.g., aluminum, carbon steel, stainless steel, copper) is attached (with electrical continuity) to a traveling platen. The substrate is held at ground, while the magnetic brush applicator shell is biased according to the polarity of the toner. For example, negatively charged toner would require a negative bias on the shell to propel the particles away from the developer on the shell to the grounded support. The shell and substrate are set at a spacing of 0.020 inches, the core is rotated clockwise at 1500 rpm, and the shell is rotated at 15 rpm counter-clockwise. The substrate platen was set to travel at a speed of 3 inches per second. The nap density on the development roller was ~0.5 g/in 2. After coating, the substrate was heated in an oven to cure the thermosetting toner.

Ideally, a rotating developer should maintain a constant, and low tribocharge (of either polarity) to maximize laydown capacity and uniformity. To achieve this performance, a combination of materials is required. Charge agents are required to adjust charge level and/or stability. Surface treatment is usually employed to manage flow and delivery of the toner to and in the applicator-mixing sump. Our results show that the level of surface treatment also interacts with the charge agent and particle size to determine the charge level and stability in these rotating magnet. Toner for use in the invention is, broadly, electrostatically chargeable powder for electrostatic coating systems, monocomponent development systems, or two-component development systems. Toner, such as the powder particles, are polymeric or resin-based. Although thermoplastic resins are useable, thermosetting powders are more preferred. In two-component development, the toner is mixed with magnetic carrier particles to form the developer, as explained above.

Electrographic printers typically employ a developer having two or more components, consisting of resinous, pigmented toner particles, magnetic carrier particles and other components. The developer is moved into proximity with an electrostatic image carried on an electrographic imaging member, whereupon the toner component of the developer is transferred to the imaging member, prior to being transferred to a sheet of paper to create the final image. Developer is moved into proximity with the imaging member by an electrically-biased, conductive toning shell, often a roller that may be rotated co-currently with the imaging member, such that the opposing surfaces of the imaging member and toning shell travel in the same direction. Located adjacent the toning shell is a multipole magnetic core, having a plurality of magnets, that may be fixed relative to the toning shell or that may rotate, usually in the opposite direction of the toning shell. The developer is deposited on the toning shell and the toning shell moves the developer into proximity with the imaging member, at a location where the imaging member and the toning shell are in closest proximity, referred to as the "toning nip."

As described in U.S. Pat. No. 6,228,549, conventionally, carrier particles made of soft magnetic materials have been employed to carry and deliver the toner particles to the electrostatic image. U.S. Pat. Nos. 4,546,060; 4,473,029; and 5,376,492: the teaching of which are incorporated herein by reference in their entirety, teach the use of hard magnetic materials as carrier particles and also the apparatus for the development of electrostatic images utilizing such hard magnetic carrier particle with a rotating magnet core applicator. These patents require that the carrier particles comprise a hard magnetic material exhibiting a coercivity of at least 300 Oesteds when magnetically saturated and an induced moment of at least 20 emu/g when in a field of 1000 Oesteds. The terms "hard" and "soft" when referring to magnetic materials have the generally accepted meaning as indicated on page 18 of "Introduction To Magnetic Materials" by B. D. Cullity published by Addison-Wesley Publishing Company 1972. These hard magnetic carrier particles represent a great advance over the use of soft magnetic carrier materials in the speed of development is remarkably increased with good image development. Alternatively, the carrier particles can be used without coating, or with an appropriate polymeric coating.

Various resin materials can be employed as coating on the magnetic carrier particles. Examples include those described in U.S. Pat. Nos. 3,795,617; 3,795,618; and 4,076,857; the teachings of which are incorporated herein by reference in their entirety. The choice of resin will depend upon its triboelectric relationship with the interned toner. For use with toners, which are desired to be positively charged, preferred resins for the carrier coating include fluorocarbon polymers such as poly(tetrafluoroethylene), poly(vinylidene fluoride) and ploy(vinylidene fluoride-co-tetrafluoroethylene). For use with toners which are desired to be negatively charged, preferred resins for the carrier include silicone resins, as well as mixtures of resins, such as a mixture of poly(vinylidene fluoride) and polymethylmethacryalte. Various polymers suitable for such coatings are also described in U.S. Pat. No. 5,512,403, the teaching of which are incorporated herein by reference in their entirety.

The carrier particles may also be semiconductive or conductive as described in U.S. Pat. Nos. 4,764,445; 4,855,206; 6,228,549; and 6,232,026; the teaching of which are incorporated herein by reference in their entirety.

The particle size of the carriers is less than 100μ volume average diameter, preferably from about 3 to 65μ and, more preferably, about 5 to 20μ. The carrier particles are then magnetized by subjecting them to an applied magnetic field of sufficient strength to yield magnetic hysteresis behavior.

Multiple toning stations can be used to produce a thick coating layer. If a first material is deposited in two or more layers by two or more magnetic brush applicators, banding can occur. To counteract this artifact, a phase relationship between the rotating cores can be maintained, so that, if magnetic pole transitions of upstream development stations produce banding in the image, the rotating core of downstream stations fill in the light bands in the image. The phase relationship may be maintained by gearing, with a differential for adjusting the phase of each roller relative to the other manually or automatically. It may also be maintained by individual electric motors for each magnetic core. Using sensors, such as optical density detectors or video cameras, a process control loop can be implemented to maintain a phase relationship between a first magnetic brush and a second magnetic brush so that a uniform coating free of banding is obtained.

Although the magnetic brush with a rotating core will typically be used with the shell rotating cocurrent with the receiver and the core rotating countercurrent to the direction of travel of the receiver, in certain situations it may be advantageous to utilize the shell rotating cocurrent with the receiver, countercurrent with the receiver, slowly moving in either direction or stationary, and either direction of core rotation.

The process of application of the toner to the photoconductive member is optimized to develop the latent image, and at the same time, minimize the transfer of material to the background or non-image areas. The charge of the image and non-image areas are such that correctly charged toner will be attracted to the image area and repelled from the non-image area. Sometimes, toner particles can become reversed-charged from their normal state, due to incorrect or insufficient dispersion of charging agent, or for other reasons. These reversed charged particles can become imaged to the background area, causing image defects.

In the development process, toning materials are often violently engaged with the photoconductive element in order to develop the latent image. This process can provide a source for airborne toner. This airborne toner can easily collect on surfaces near the development zone. As these deposits collect, they can build up and drop off the neighboring surfaces and be developed onto the photoconductive element.

Sometimes the two-component developer material, including a powder toner and a charge carrier material, can build up on or near the toner roller and when even small amount of toner build up, the subsequent intermittent release of this debris in bunches or clumps of toner and/or carrier debris creates unacceptable printing artifacts. One reason this occurs is because the toner that is either the wrong sign or 0 sign (neutral) by nature and this material will show up in none image area of the print as an artifact. This generates an unacceptable level of toner on a printer, and in particular, on prints from machines running at faster rates and that are required to have a very high quality of image. These debris releases typically cause image defects and can accumulate to an extent that the machine is shut down to be cleaned. This results in frequent stoppages and is reduced quality. It is therefore an object of the present invention to provide a self-cleaning device in the development zone and a nearby collection area for normally charged and reverse-charged marking particles. It can also be helpful in preventing other types of artifacts that are caused by any toner build up at the toner roller.

Figure 2:
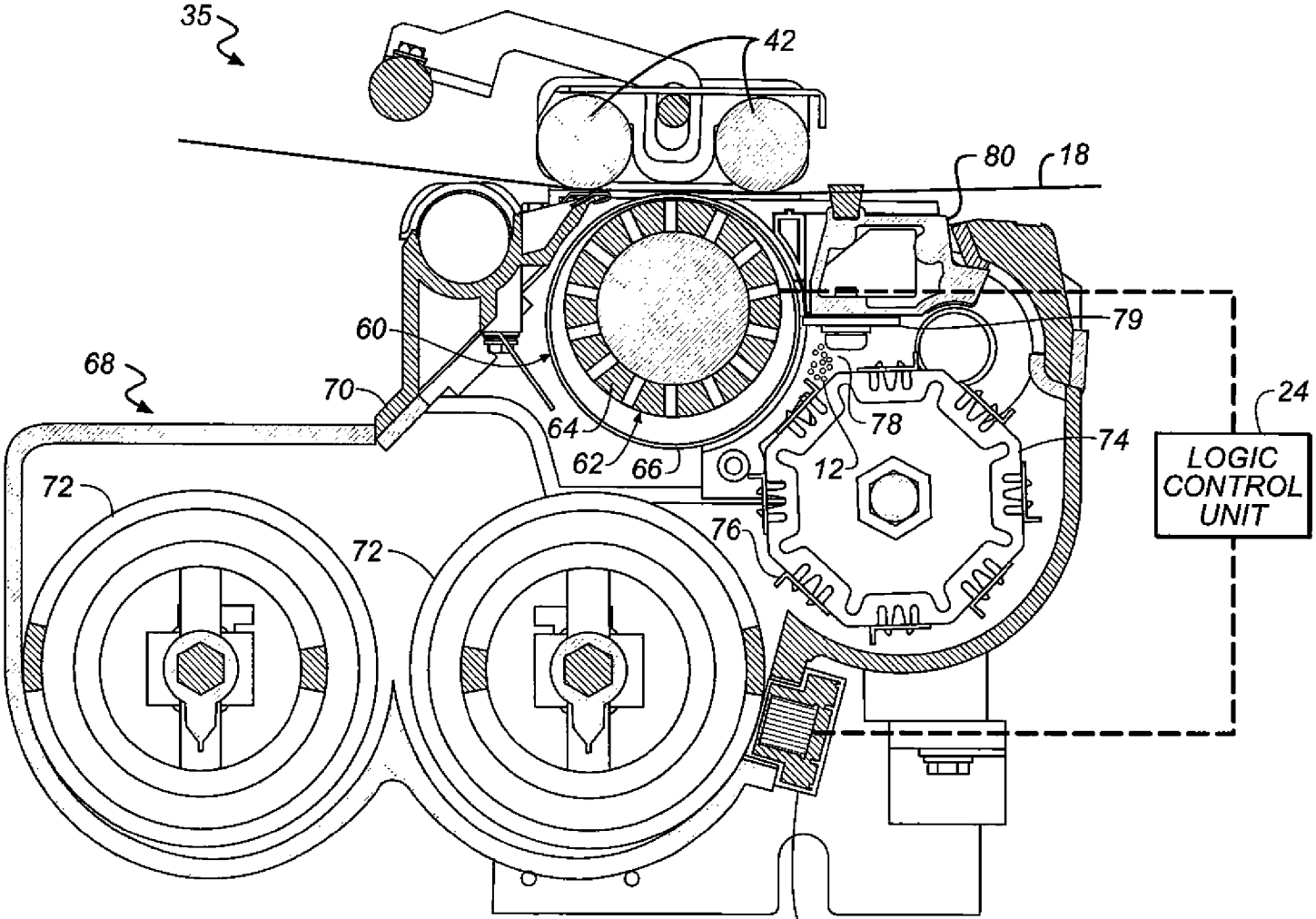
FIG. 2 is a schematic cross-sectional side view representation of an electrographic toning station, according to one aspect of the invention.

FIG. 2 shows the toning station 35, also referred to as developer station, and a toning roller 60 with a rotating magnetic core 62 having reverse polarity magnets 64 as well as a toning shell 66. Also in the toning station 35 is a mixing station 68 located in a developer housing 70 with one or more mixing devices 72. As discussed above a toner replenisher 42 periodically introduces additional toner and the toner and magnetic carrier particles are mixed in the mixing devices 72 to maintain a uniform amount of development mixture. This development mixture is controlled in accordance with various development control processes that use information gathered from various devices, such as the toner concentration monitors 57. The two-component developer material 12 including the toner 14 and the charge carrier material 16 are transferred via a transfer roller, also referred to as a transport roller, 74 along carrier devices 76, in one embodiment as shown in FIG. 2, to form a toner nap 78 near a skive 79 adjacent a self-cleaning toner roller system 80 and the toning roller 60, including the rotating core 62 in the toning shell 66.

Figure 3:
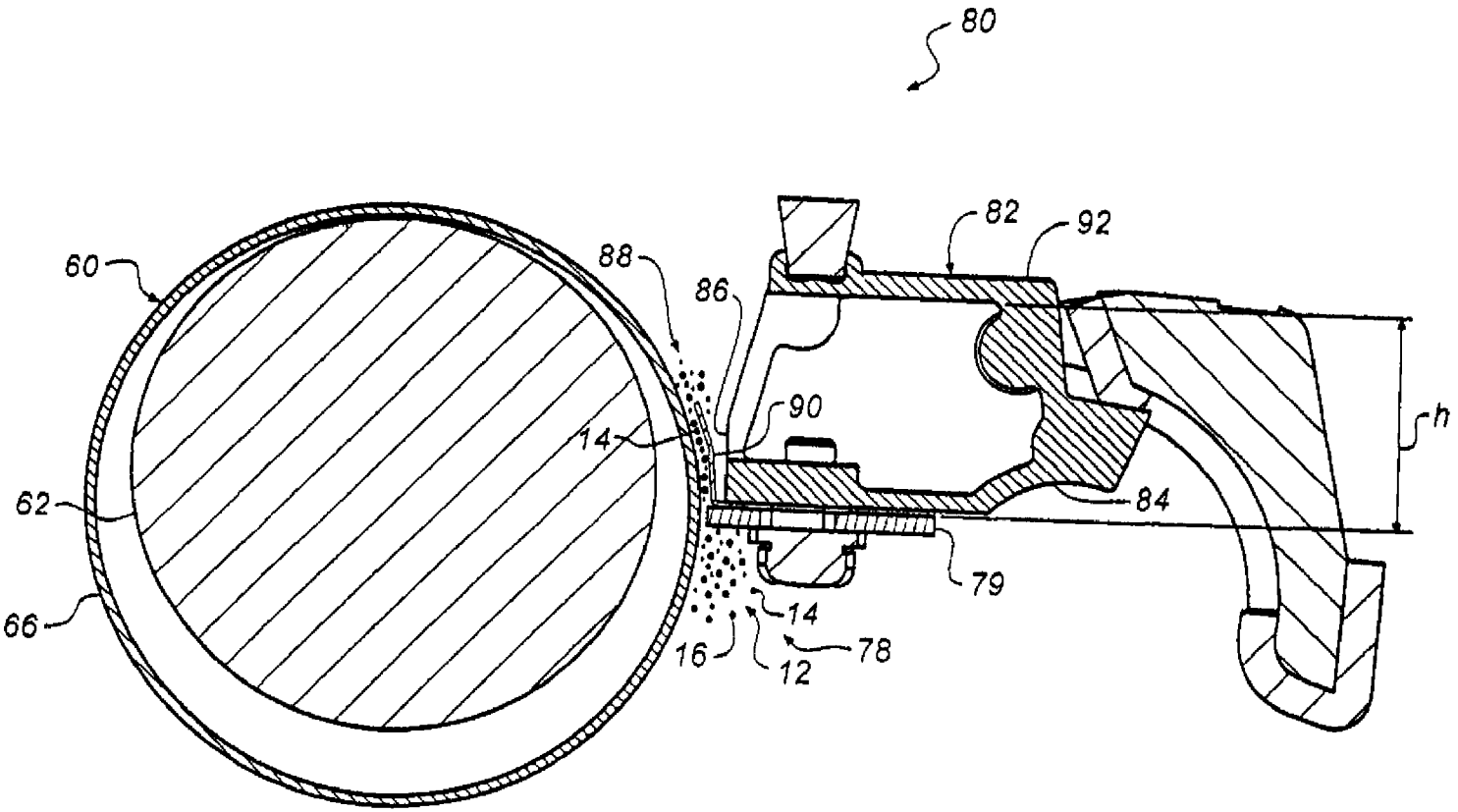
FIG. 3 is a cross-sectional side view of a portion of the electrographic toning station, according to one aspect of the invention.

FIG. 3 shows the self-cleaning toner roller system 80 including at least one cleaning device 82 including a cleaner device body 84 with a cleaner device body front face 86 a height h adjacent the toner roller 62 to capture the toner debris 88 from adjacent the toner roller that would normally build up due to the interaction of magnetic carrier particles and charged toner particles and any metal surfaces near the toner station such as the skive assembly, especially material, containing toner that is either the wrong sign or 0 (neutral) sign by nature or as a result of those interactions. Since this material will show up in none image area of the print as an artifact the self-cleaning device is useful in preventing this from occurring.

The self-cleaning toner roller device 80, sometimes referred to as the cleaning device, includes one or more shields 90 intermediate the toner roller 62 and a front face 86 of the cleaner device body to collect toner debris 88 from the toner roller surface 66. A self-contained toner debris receptacle 92 having one or more openings to collect the debris is adjacent the shield 90. In one preferred embodiment the toner debris receptacle 92 is contained within the cleaner device body 84 to collect the toner debris 88. Optionally a controller 24 can move the applicator from an operational mode to a self-cleaning mode. Another self cleaning mode can simply involve speeding up the operating speed of the printer for a short period of time to further clean the toner roller in a cleaning cycle since this allows the nap to operate more effectively as a self-cleaner.

The shield 90 must be located near enough to the toning roller 62 to collect the debris before it becomes a problem and causes printing artifacts but far enough away to not interfere with the properties of the developer or the nap created adjacent the skive 79 or to create a blockage as the toner 14 passes the skive 79 through the restriction it creates with the toner roller 62. The spacing distance and other aspects of this cleaning device are very important because if the shield 90 is placed too near the toner roller it will disturb the formation of the nap and/or disturbs the movement of developer, both of which create problems like the formation of a non-uniform nap. These problems can result in the formation of unwanted artifacts that are worse then those being corrected due to debris build-up. Thus the design and placement of the self-cleaning toner roller system 80, especially the shield 90, is critical to a successful self-cleaning device. This has prevented others from successfully implementing a toner roller self-cleaning device in an electrophotographic printer.

The spacing of the self-cleaning device to the toner roller as well as the height of the device, including the shield, as well as the placement of the cleaning device relative to the toning roller, including angle to the skive face, must be closely controlled. These and the other variables discussed are determined based on the size of toner and carrier particles, the thickness of the nap, the magnetic properties of the toner roller, including magnetic strength, as well as the skive to toner roller spacing, the machine printing speed and environmental conditions. The formation of artifacts does become more noticeable as the printing press is used to print "photo rich" prints that have great detail and color saturation as well as when the prints contain large areas of black ink or a great amount of fine detail. Different paper types can also cause any artifacts to become more noticeable. It is in these cases where the present invention is especially critical to a successful printing job.

Experimentation has help determine that the cleaning shield 90 should be placed adjacent the toning roller a distance between 0.4% and 2% of the toning roller's diameter, preferably a distance between 0.5 mm and 1.5 mm from the toning roller in the present embodiment. The cleaning shield 90 is effective when it is placed nearly parallel to the toning roller but one embodiment of the cleaning shield 90 is actually is a two part angled device that roughly follows the toner shell surface hut has a second part that is angled away from the body face of the cleaning device, as shown in FIG. 3. The shield is also effective when it has a height less then one half the front face height h of the cleaning device. The shield is also effective when placed at an angle to the body face of the cleaning device so that the included angle of contact between the shield and the body face is on the order of 5 to 30 degrees, inclusive preferable nearer 10-20 degrees, inclusive.

The shield may be any material capable of withstanding the conditions with in the developer station without disturbing the developer or its transfer. One example of a suitable material is thin steel between 0.002 and 0.006 inches thick.

Figure 4:
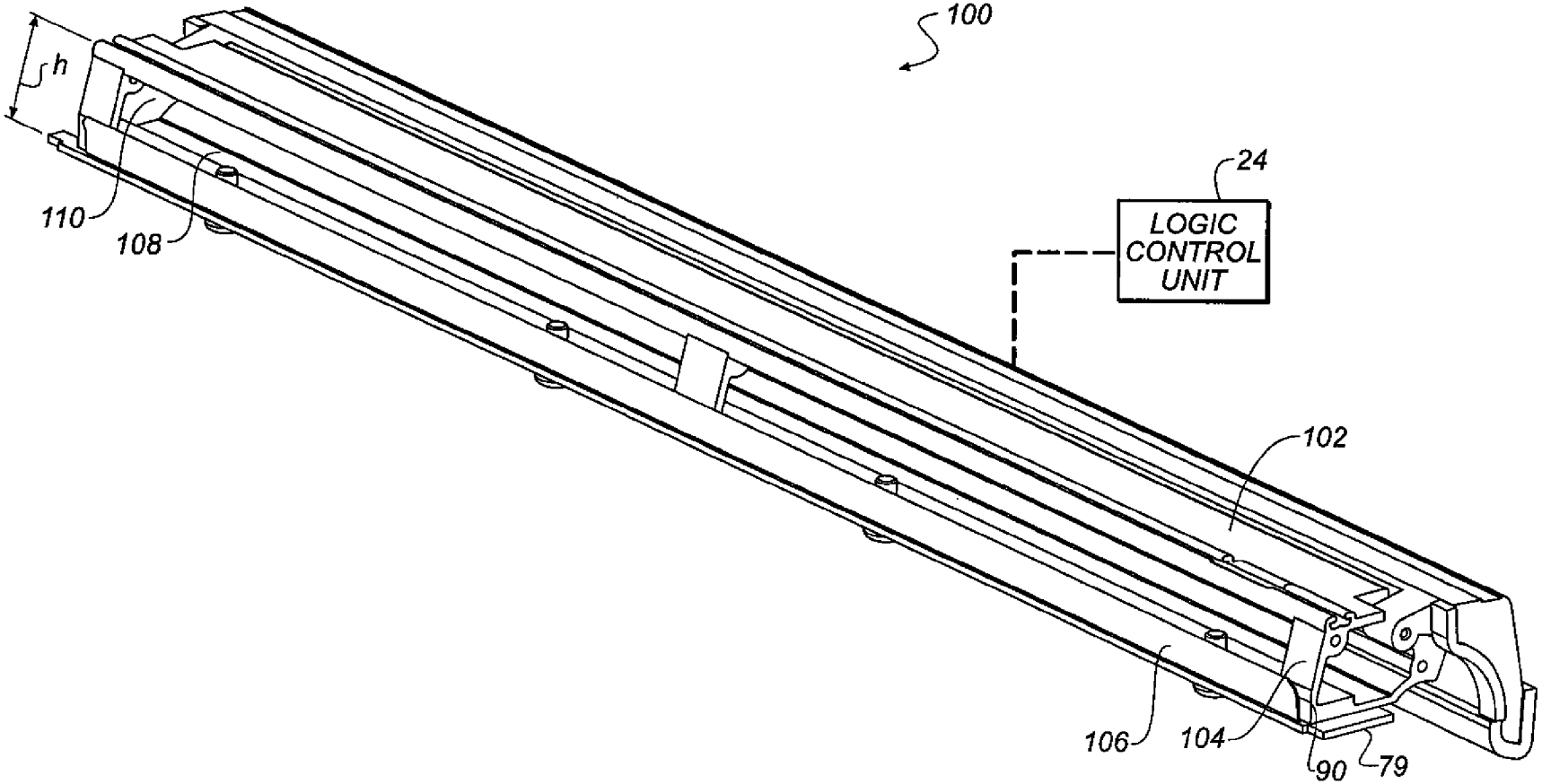
FIG. 4 is a perspective view of an embodiments of the self-cleaning toner roller with parts broken away.

One preferred embodiment of the self-cleaning toner roller system is shown in FIG. 4. This cleaning device is housed in a skive block assembly that is a self-cleaning toner roller system 100. The self-cleaning toner roller system 80 would not have to be a modified skive block assembly, as one skilled in the art would understand, but is shown here as such for illustrative purposes. A conventional skive block assembly is usually located adjacent the toning roller 60 and the toning shell 66 and normally has a solid face to direct toner toward the toner roller 62.

The self-cleaning skive device and system 100 shown includes a cleaner device body 102 with a cleaner device body front face 104 having a height h. The self-cleaning system 100 and is located adjacent the toner roller 62, as shown in FIG. 3, to capture the toner debris from the adjacent the toner roller that would normally build up and cause printing problems including artifacts. The cleaning device 100 includes one or more shields 106 intermediate the toner roller 62 and the cleaner device body front face 104 to collect the toner debris 88 from the toner roller surface 66. A self contained toner debris receptacle 108 having one or more openings 110 (here two are shown) to collect the debris is adjacent the shield 104, thus the toner debris receptacle 108 is contained within the cleaner device body 102 to collect the toner debris.

The cleaning shield can be made from a variety of suitable materials. One example of a suitable material is 0.020 Alum. It could also be made from a very flexible 0.005 material that could self adjusting to the toning nap or from a thin steel between 0.002 and 0.006 inches thick. The included angle of contact between the blade and a tangent to the surface at the point of contact with the moving surface 106 may be on the order of 0 to 30 degrees, inclusive, and may be on the order of 10 to 20 degrees, inclusive. The tip force perpendicular to the moving surface 106 at the point of contact may be on the order of 1 ounce to 5 ounces per linear inch, inclusive, and may be between 2 ounces and 4 ounces per linear inch, inclusive.

During a self-cleaning mode that can be aided by a controller 24 the nap will clean the shield and help move the toner debris 88, with the assistance of the carefully placed one or more shields 106, toward the cleaner device body front face 104 and through the one or more openings 110 (here two are shown) to be captured in the self contained toner debris receptacle 108. The shield also acts to prevent the debris from escaping from the self-contained toner debris receptacle 108 once it is collected but before or is removed for disposal. The toner debris receptacle can contain a cleaning solution including an organic solvent and further can be automated to have the debris removed form the cleaning device at indicated times it is full or continuously through one or more extraction systems for toner removal.

The invention has been described in detail with particular reference to certain preferred embodiments thereof, but it will be understood that variations and modifications can be effected within the spirit and scope of the invention.

The invention claimed is:

1. A electrophotographic self-cleaning toner roller device used during the coating of electrophotographic prints, wherein the cleaning device comprises:

a. at least one cleaning device having a cleaner device body with a cleaner device body front face a height (h) adjacent a toner roller to capture the toner debris from the toner roller;

b. one or more cleaning shields intermediate the toner roller and the cleaner device body front face to restrict a nap of charged toner and toner debris during a length of movement of the nap before printing and c. a self-contained toner debris receptacle in the cleaner device body to collect the toner debris.

d. wherein toner debris in the nap is urged away from the toner roller while the nap is restricted by the one or more cleaning shields and wherein the one or more cleaning shields are posititioned so when the nap is moved past the one or more cleaning shields, the toner debris is urged beyond the one or more cleaning shields to the self-contained toner debris receptacle.

2. The apparatus of claim 1, wherein the cleaning device is a skive block assembly having a center toner debris receptacle and a cleaning shield attached.

3. The apparatus of claim 1, wherein the cleaning device further comprises a controller that controls the cleaning device based on one or more of the following including the size of developer particles, the thickness of the nap, the magnetic properties of the toner roller, including magnetic strength, as well as the skive to toner roller spacing , the machine printing speed and environmental conditions.

4. The apparatus of claim 1, wherein the toner debris receptacle further comprises a cleaning solution including an organic solvent.

5. The apparatus of claim 1, further comprising a self-cleaning mode including removing residue form the cleaning device.

6. The apparatus of claim 5, wherein electrophotographic cleaning device further comprises one or more extraction systems for toner removal.

7. The apparatus of claim 1, wherein the cleaning shield is placed adjacent the toning roller a distance between .4% and 2% of the toning roller's diameter.

8. The apparatus of claim 1, wherein the cleaning shield is placed a distance between .5 mm and 1.5 mm from the toning roller.

9. The apparatus of claim 1, wherein the cleaning shield is placed at an angle to the body face so that the included angle of contact between the shield and the body face may be on the order of 5 to 30 degrees, inclusive.

10. The apparatus of claim 1, wherein the cleaning shield has a height less then one half the front face height h of the cleaning device body.

11. A method for automatic self-cleaning of an electrophotographic toner roller during printing operations comprising the steps of:

a. operating an electrophotographic printer at an operating speed including applying a charged toner to form a nap on the toner roller while oppositely charging the toner roller to attract charged toner to the toner roller such that the toner roller can be rotated to carry the nap of charged toner from a development station to a position where the charged toner is used for coating electrophotographic prints;

restricting the nap between the toner roller and a shield for a portion of a length of travel extending from a rotational position where the nap is formed to a rotational position where the charged toner is used for coating electrophotographic prints. such that the opposite charge of the drum or centrifugal forces created by drum rotation urge any toner debris in the nap away from the drum against the shield during the restriction and to separate from the nap when the restriction ends allowing the toner debris to be urged past the shield; and b. collecting the toner debris that is urged past the shield; and c. automatically controlling one or more steps a to c in conjunction with printing.

12. The method of claim 11, wherein one or more automatic steps further comprises automatically controlling one of the steps in response to at least one of a time period or a sensor reading.

13. The method of claim 11, wherein the method further comprises one of automatically slowing down from the operating speed or stopping the printer to remove the debris removing all residue prior to restarting printing.

14. The method of claim 11, wherein the cleaning device cleans toner that is either the wrong charge to be attracted to the drum or neutral by nature proximate the toning roller preventing artifacts non-image area of a print.

15. The method of claim 11, wherein further comprising the step of cleaning toner debris from a collector using a self contained chemical or apparatus.

16. The method of claim 11, wherein the placement step is a size of the restriction is determined based on one or more of the following including the size of developer particles, the thickness of the nap, the magnetic properties of the toner roller, including magnetic strength, as well as the skive to toner roller spacing, the machine printing speed and environmental conditions.

17. The method of claim 11, wherein the operating speed is sped up to further clean the toner roller in a cleaning cycle.

18. An electrophotographic self-cleaning toner roller system comprising:

a cleaning device, comprising a toner debris receptacle and a shield, proximate a toner roller to prevent toner debris from separating from a nap of charged toner for a portion of a length of travel of the nap before the nap is used for minting and to capture toner debris that is urged past the shield after the nap is moved past the shield to prevent artifacts in a non-image area of a print; and a controller to move the cleaning applicator to one of an operational mode or a self-cleaning mode.

19. The apparatus of claim 18, wherein the operational mode comprises placing one or more cleaning devices proximate the toning roller to remove residue.

20. The apparatus of claim 18, wherein the controller uses input from manufacturing information including one or more of a sensor, timer, electrical information and printer information including the size of developer particles, the thickness of the nap, the magnetic properties of the toner roller, including magnetic strength, as well as the skive to toner roller spacing, the machine printing speed and environmental conditions.

* * * * *